US006929050B2

(12) United States Patent
Puffer, Jr. et al.

(10) Patent No.: US 6,929,050 B2
(45) Date of Patent: Aug. 16, 2005

(54) WAX RUNNERS FOR CASTING

(75) Inventors: Raymond H. Puffer, Jr., Watervliet, NY (US); Bruce S. Phipps, Millbrook, NY (US); Daniel Walczyk, Brunswick, NY (US); Rory MacKean, Jaffrey, NH (US); Jason Chalfant, Troy, NY (US)

(73) Assignee: MPI Incorporated, Poughkeepsie, NY (US)

( * ) Notice: Subject to any disclaimer, the term of this patent is extended or adjusted under 35 U.S.C. 154(b) by 72 days.

(21) Appl. No.: 10/600,551

(22) Filed: Jun. 20, 2003

(65) Prior Publication Data

US 2004/0256072 A1 Dec. 23, 2004

(51) Int. Cl.[7] ..... B22C 7/02; B22C 9/04
(52) U.S. Cl. ..... 164/35; 164/45; 164/235
(58) Field of Search ..... 164/35, 45, 516, 164/235, 246

(56) References Cited

U.S. PATENT DOCUMENTS 4,064,927 A * 12/1977 Ostrowski ..... 164/244
2003/0111203 A1 * 6/2003 Mertins ..... 164/34

* cited by examiner

*Primary Examiner*—Kuang Y. Lin
(74) *Attorney, Agent, or Firm*—Heslin Rothenberg Farley & Mesiti P.C.

(57) ABSTRACT

A wax runner is provided having risers along the edge of the surface which is melted to attach the wax gates of wax patterns to the wax runner. The risers prevent the flow of molten wax over the edge of the wax runner. In addition to the risers or separately, at least one locator extends from both ends of the wax runners, the locators are aligned with one another and assure a constant distance between the ends of the wax runner and the wax pattern being affixed to it. The locators further provide a fixed reference point.

10 Claims, 8 Drawing Sheets

WAX RUNNERS FOR CASTING

BACKGROUND

Field of the Invention

This invention relates to the production of wax trees and more particularly to the design of wax runners. The invention prevents melting wax from flowing over the edge of the wax runner and assures alignment of the wax patterns being attached to the wax runner with the end points of the wax runner.

The Lost Wax Process is a long established process for casting. In the practice of the Lost Wax Process, a pattern of a part to be cast is molded in wax. When the wax pattern is molded, it is molded in one piece with a wax pattern gate. The wax pattern gate is an addition to the wax pattern for the purpose of attachment to the wax runner. Wax runners are also molded separately. Wax runners can have a variety of shapes but essentially have at least one bar with flat surfaces and frequently but not always with a pour cup at one end. The wax pattern gates are affixed to the wax runner. To do this, both the end of the wax pattern gate and the surface of the wax runner need to be heated to melt wax and create a fusion. Once the wax patterns are affixed to the wax runner, ceramic material is placed on the wax runner with the wax patterns attached. Once the ceramic has hardened, it is heated causing the wax to flow out of the ceramic. The ceramic thus forms a mold into which the molten material, frequently a metal, is poured to produce the desired part.

In recent times, much of the Lost Wax Art has been substantially automated. However, the fusion of wax pattern gates to a wax runner has been traditionally a manual operation performed by heating putty knives on a Bunsen Burner to melt the surface of the wax runner and the end of the pattern gate. In the patent application of Ludwig, et al, entitled Process and Apparatus for the Assembly of Wax Trees, Ser. No. 10/304,840, assigned to the same assignee, an advanced process and apparatus is taught for automating the fusion of wax pattern gates to a wax runner.

Maintaining a wax runner in a perfectly flat position when attaching wax patterns is a most desirable goal, but unfortunately that goal is not readily attainable. As a result, portions of the wax runner are penetrated more deeply by the heated blade than other portions. Excess molten wax is a result of excessive melting. Should the excess melted wax run over the side of the wax runner, the wax runner and the wax patterns attached to it are not useable resulting in lost product. Wax runners, in the new automatic process are held in a runner station which holds the runner at both ends. Since wax is not a structurally strong material, the wax runner frequently is at least slightly warped or bent.

Beside it being advantageous to securely hold the wax runner, it is most advantageous to have a certain relationship between the centerline of the ends of the wax runner and the wax patterns. This provides an accurate reference point not only for the wax pattern but also for the resulting castings. The accuracy of the location of the wax runner is especially important with the automated process for affixing wax patterns to wax runners since the robotic devices provide accuracy in all three directions.

Therefore, it is highly advantageous to provide a wax runner which prevents molten wax from running over the edge of a wax runner. It is also desirable to securely hold the wax runners and to maintain a fixed relationship between the ends of the wax runner and the wax patterns.

Objects

Therefore, the objects of this invention are to provide the following:

- a wax runner configured to retain molten wax on the melted surface and prevent wax flow over the edge of the wax runner, and
- a wax runner configured to retain each wax runner in a fixed position to assure a constant relationship between the ends of the wax runner and the wax patterns being attached to the wax runner.

These and other objects of the present invention will become readily apparent upon further review of the following specifications and the accompanying drawings.

SUMMARY OF THE INVENTION

A wax runner is provided for use in forming a wax tree by fusing the wax pattern gates to the wax runner. The wax runner has at least one branch of wax having two ends and at least one flat surface. The wax runner has a head at one end frequently including a pour cup and a tail at the other end. A pair of risers are located along the edges of the branch and extend into the head and the tail. The wax runner also has at least one locator on the head and at least one locator on the tail. The locators are aligned with one another. The wax runner can have either the risers or the locators or may have both the locators and the risers.

DETAILED DESCRIPTION OF THE DRAWINGS

DESCRIPTION OF THE NUMERALS

| Numeral | Description |
|---|---|
| 11 | Wax runner |
| 13 | Riser |
| 15 | Branch |
| 17 | Head |
| 19 | Tail |
| 21 | Pouring Cup |
| 23 | Connecting Rod |
| 25 | Edges |
| 27 | Surfaces |
| 29 | Wax Pattern |
| 31 | Locator |
| 33 | Two Flat Surfaces |
| 35 | Stock |
| 37 | Head Stock |
| 39 | Tail Stock |

-continued

DESCRIPTION OF THE NUMERALS

| Numeral | Description |
|---|---|
| 41 | Centerline (locator) |
| 43 | Centerline (wax pattern) |
| 45 | Wax Pattern Gates |
| 47 | Cutoff |

DETAILED DESCRIPTION OF THE INVENTION

Figure 1:
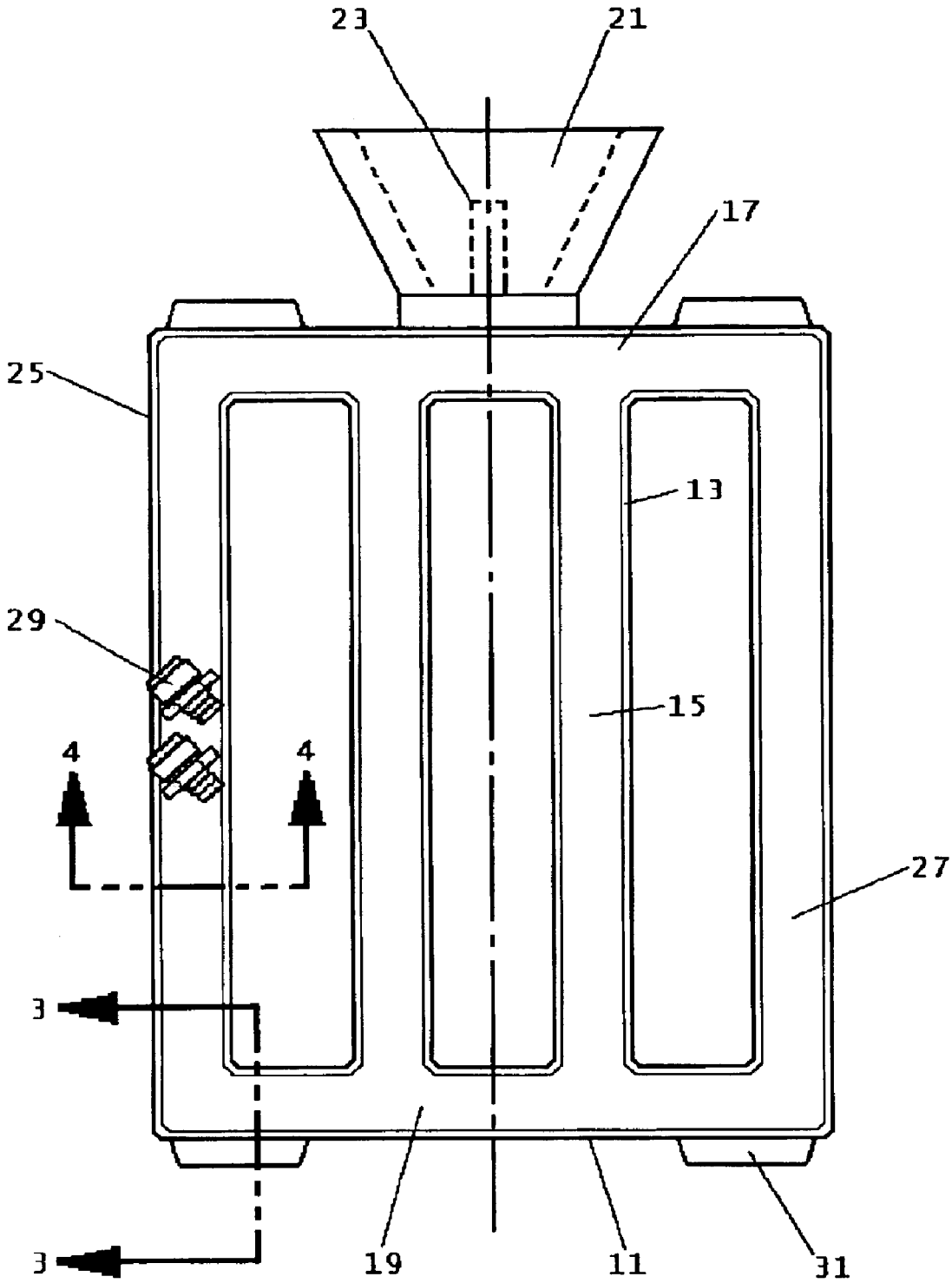
FIG. 1 is a plan view of a wax runner showing both the locations and the riser along the surface of the wax runner.
Figure 2:
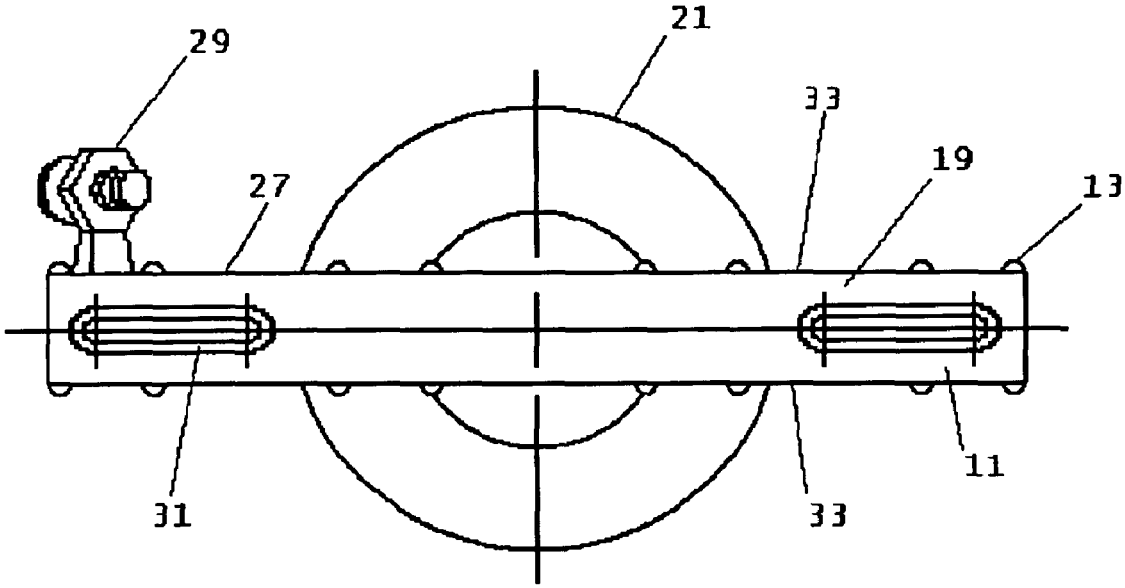
FIG. 2 is an end view of the wax runner shown in FIG. 1.
Figure 3:
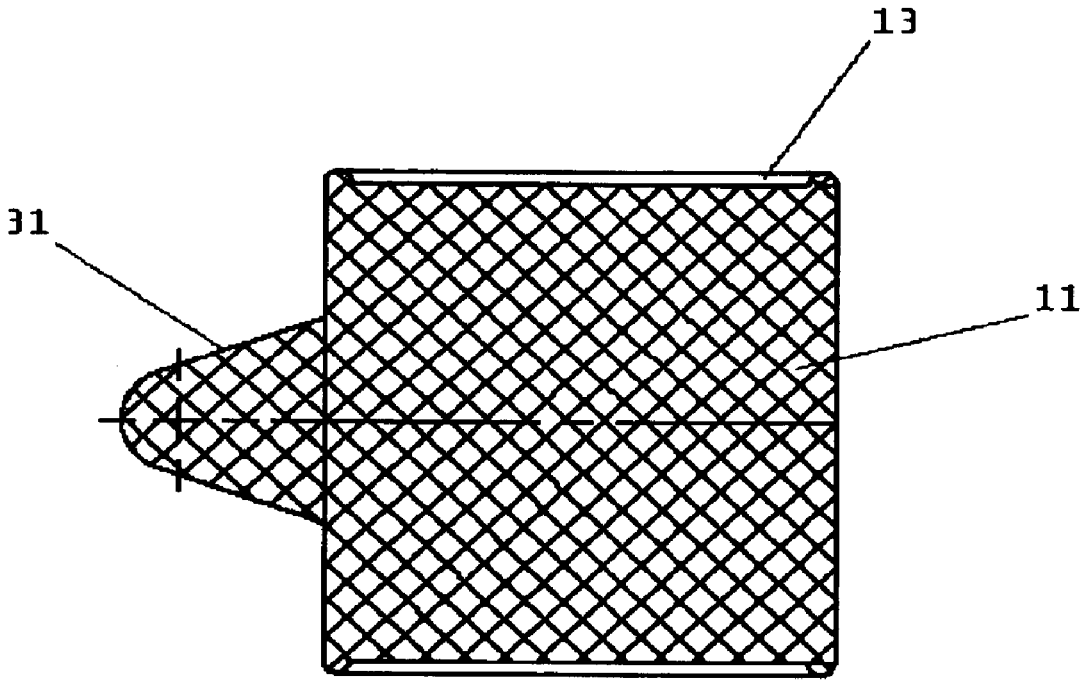
FIG. 3 is a cross-sectional view along line 3—3 of FIG. 1.
Figure 4:
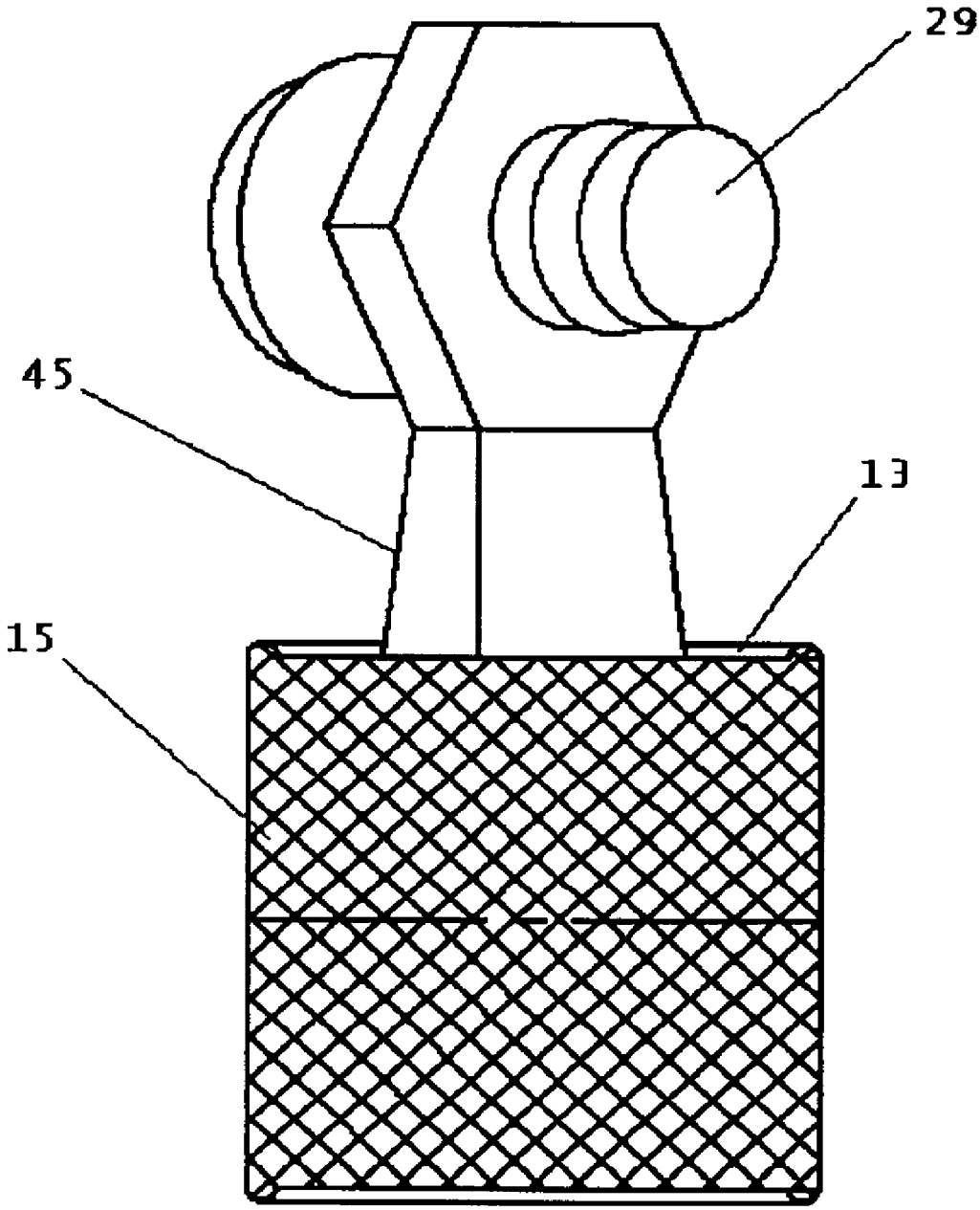
FIG. 4 is a cross-sectional view along line 4—4 of FIG. 1.
Figure 5:
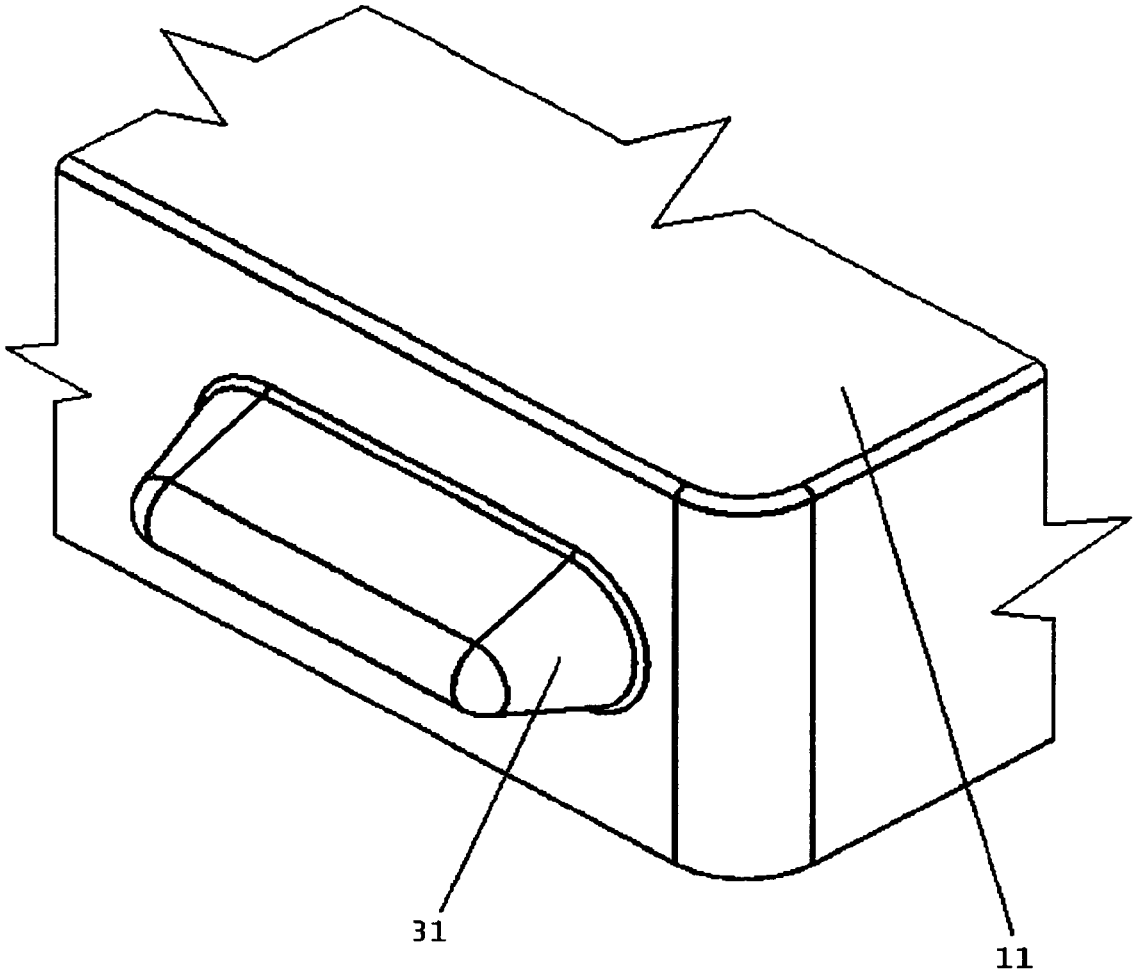
FIG. 5 is a pictorial view of the corner of a wax runner showing a locator.

Referring now to FIGS. 1 and 2, a wax runner 11 is shown which includes risers 13 located along the edge of the wax runner 11. The wax runner 11 that is shown includes four branches 15 connected together by a head 17 and a tail 19. At the head 17, a pouring cup 21 and connecting rod 23 are located. Wax runners 11 are frequently but not always constructed with a pouring cup 21. The risers 13 extend above the surface 27 of the branches 15 of the wax runners 11 and are located parallel to and along the edges 25 of the branches 15 of the wax runner 11 and about the head 17 and the tail 19. As best seen in FIG. 2 and FIG. 4 each riser 13 is a small elongated lip or ridge or dam with a rounded top. When using the riser 13, it is essential that the surface of the knife (not shown) being used to melt the wax on the surface 27 of the wax runner 11 fits between the risers 13. In FIG. 1, wax patterns 29 are shown affixed to the wax runner.

The use of the risers 13 on the wax runner 11 provides an assurance that the wax runner 11 will not have to be rejected due to wax running over an edge 25 of the the surface 27 of the wax runner 11.

As also best seen in FIGS. 1, 2, 3 and 5, locators 31 are added to the head 17 and tail 19 of the wax runner 11. The locators 31 are significant protrusions on both the head 17 and tail 19 of the wax runner 11 and are located generally centrally between the two flat surfaces 33 of the wax runner 11. Two locators 31 are situated on the head 17 and two on the tail 19 of the wax runner 11 adjacent the sides of the wax runner 11. The locators 31 are all aligned with one another.

Figure 6:
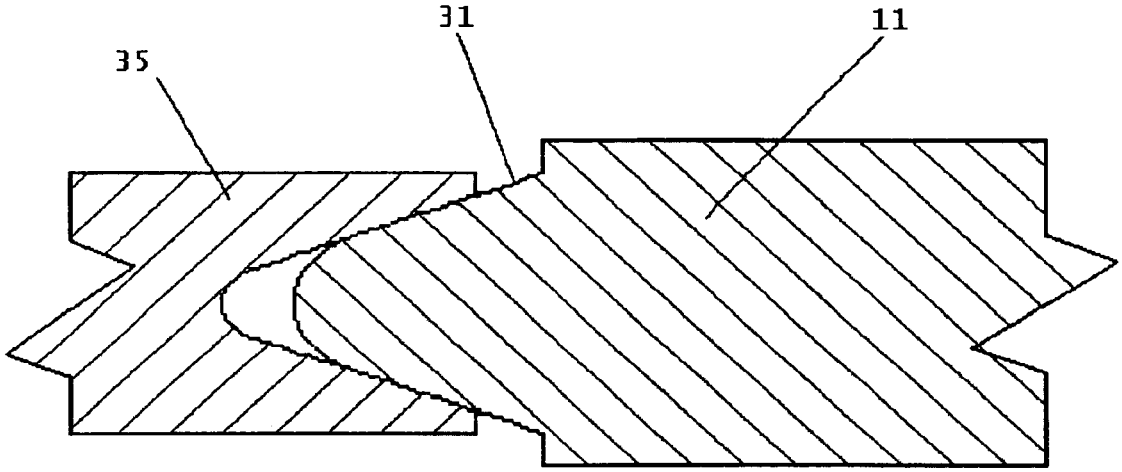
FIG. 6 is a partial cross section view of a locator and a fixture which holds the locator.
Figure 7:
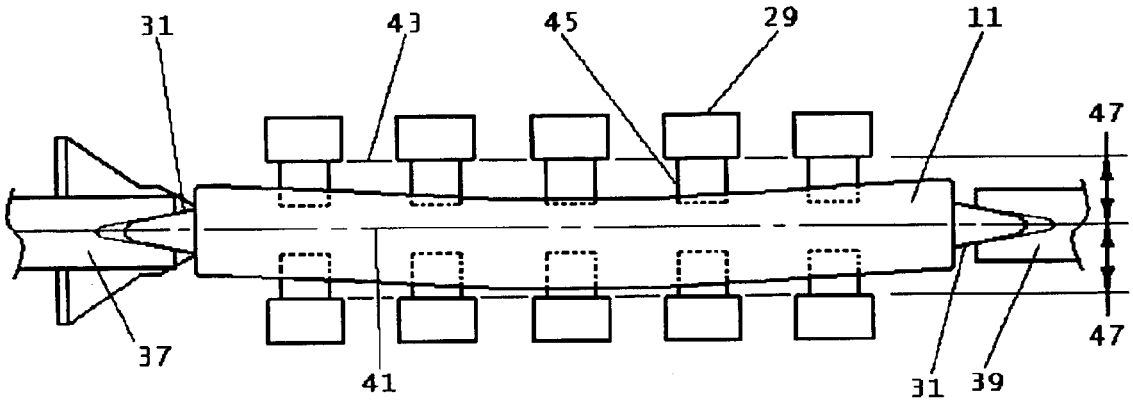
FIG. 7 is a side elevation of a wax runner with the wax patterns affixed to it showing the fixed relationship of the centerline of ends of the wax runner and the wax patterns with the wax runner slightly bent.

As best seen in FIGS. 6 and 7, the locators 31 at each end of the wax runner 11 are held by a stock 35, which could be a head stock 37 at the head 17 and a tail stock 39 at the tail 19. As seen in FIG. 7, the wax runner 11 may be warped, but the distance from the centerline 41 of the locators 31 to the center line 43 of the wax pattern 29 always remains the same. When the cast version of the wax runner 11 is produced, the casting which will be virtually identical in configuration to the wax runner 11 and wax patterns 29 shown in FIG. 7. By use of the locators 31, the pattern gates 45 are held at a consistent point along the resulting cast version of the pattern gates 45. Furthermore, the cast version of the wax runner 11 and wax patterns 29 can be secured by the cast version of the locator to permit a wide variety of operations on the cast version of the wax pattern 47 such as cutoff and machining.

The use of the risers 13 assures that molten wax, which may flow from the point of being heated so as to permit fusion with the pattern gate, will be prevented from flowing over the edges 25 of the surface 27 of the respective branch 15 of the wax runner 11 where wax is being melted. The locators 31 assure a positive holding of a wax runner 11, but of even greater importance, assure alignment between the centerline 43 of the wax patterns 29 and the centerline 41 of the locators 41.

The centerline 43 of the wax patterns 29, as shown in FIG. 7 is also the cutoff line at which the wax castings represented by the wax patterns 29 are removed from the cast gates represented by the pattern gates 45 (FIG. 7). The distance 47 remains constant despite the distortion to the wax runner 11 as shown in relation to the centerline 41.

Figure 8:
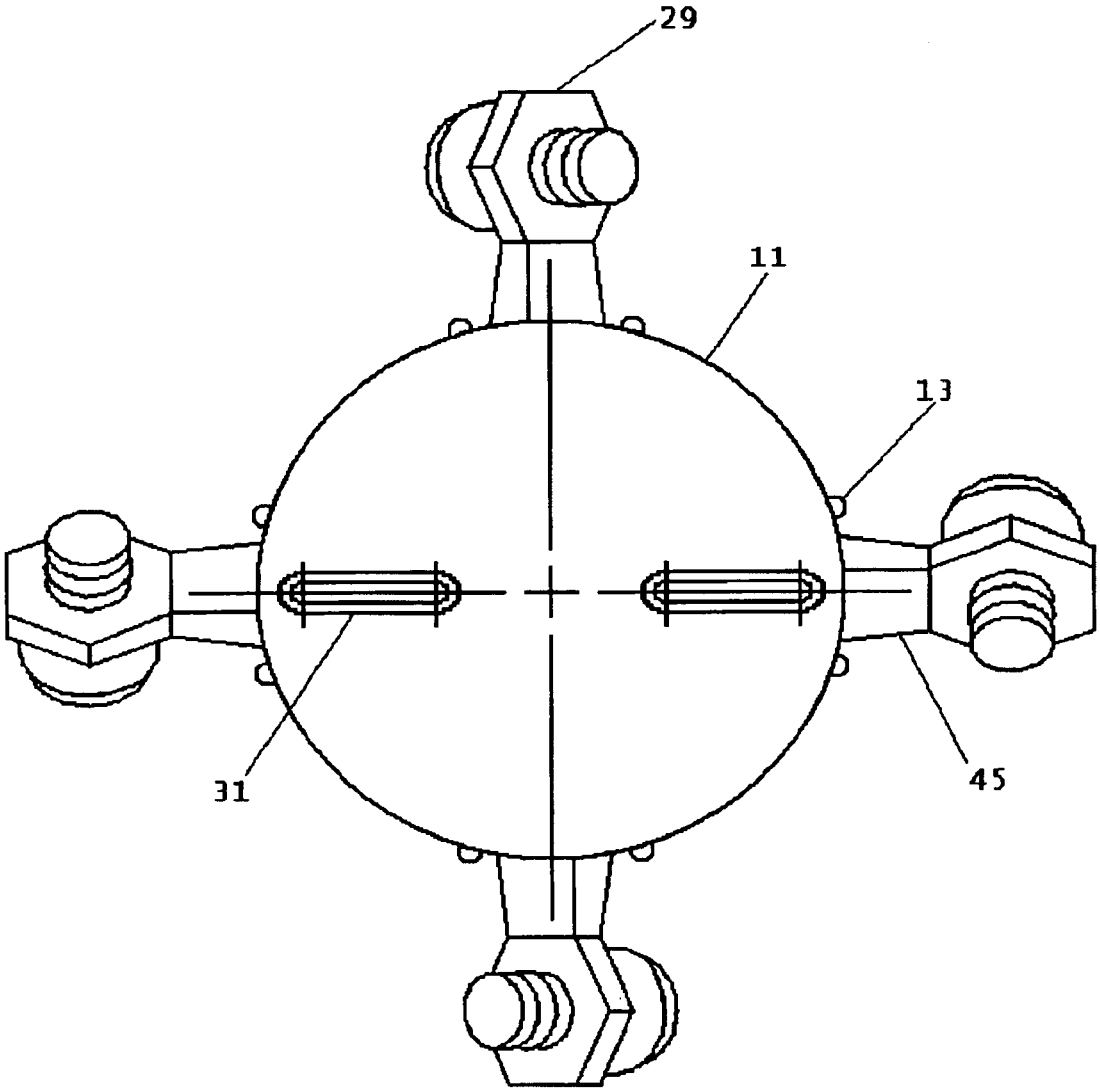
FIG. 8 is a end view of a round wax runner showing both the risers and the locators.

As an alternate to a wax runner 11 with a rectangular cross section, a wax runner may be constructed with a round or circular cross section. (FIG. 8) With a round cross section, the risers 13 cannot be placed at an edge as none exists. Instead, a series of risers 13 are placed equidistant about the circumference of the wax runner 11.

With a wax runner 11 that has a circular cross section, the locators 31 would be placed on the wax runner 11 (FIG. 8) as with a wax runner 11 having a rectangular cross section.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. A wax runner for use in forming a wax tree by fusing the wax pattern gates of wax patterns to the wax runner, the wax runner comprising:

a branch of wax having two ends and including a head at one end and a tail at the other end; and a plurality of risers located along the edges of the surface of the branch of the wax runner, wherein the risers are configured to confine molten wax to an area of the surface.

2. A wax runner according to claim 1, wherein each riser is a small rounded dam.

3. A wax runner according to claim 1 wherein the branch has a circular cross section.

4. A wax runner for use in forming a wax tree by fusing the wax pattern gates of wax patterns to a wax runner, the wax runner comprising:

at least one branch of wax having two ends and at least one flat surface and including a head at one end and a tail at the opposite end; and risers located along the edges of the flat surface of each branch, wherein the risers are configured to confine molten wax to an area of the flat surface.

5. A wax runner according to claim 4 wherein each riser is a small rounded dam.

6. A wax runner according to claim 4 wherein each branch has a rectangular cross section.

7. A combination of a wax runner and an automated wax pattern assembly system comprising:

a wax runner for use in forming a wax tree by fusing wax pattern gates to the wax runner, said wax runner comprising one branch of wax having two ends and having a tail at one end and a head at the other end and at least one locator on the head and the tail, both locators being aligned with one another; and means for positioning the wax runner in a fixture of an automated pattern assembly system.

8. A combination apparatus according to claim 7 wherein the wax runner further includes risers on the surface of the branch.

9. A combination apparatus according to claim 7 wherein the branch has a circular cross section.

10. A combination apparatus according to claim 7 wherein the branch has at least one flat surface, the flat surface having edges and having risers located along the edges.

* * * * *